US005938190A

United States Patent [19]

Campbell et al.

[11] Patent Number: 5,938,190

[45] Date of Patent: Aug. 17, 1999

[54] SPECIALTY MEDIA FEED GUIDE AND SHEET FEEDING APPARATUS USING SAME

[75] Inventors: Michael Clark Campbell; Edmund Hulin James, III; Christopher Patrick Murphy; David Kyle Murray, all of Lexington, Ky.

[73] Assignee: Lexmark International, Inc., Lexington, Ky.

[21] Appl. No.: 08/656,654

[22] Filed: May 31, 1996

[51] Int. Cl.[6] ..... B65H 1/00

[52] U.S. Cl. ..... 271/171; 271/121

[58] Field of Search ..... 271/171, 145, 271/160, 121

[56] References Cited

U.S. PATENT DOCUMENTS

| | | | |
|---|---|---|---|
| 4,501,417 | 2/1985 | Foster et al. | 271/124 |
| 4,565,360 | 1/1986 | Rünzi | 271/4 |
| 4,585,223 | 4/1986 | Tam | 271/121 |
| 4,607,834 | 8/1986 | Dastin | 271/171 |
| 4,775,140 | 10/1988 | Foster | 271/121 |
| 4,786,044 | 11/1988 | Moody | 271/171 |
| 4,838,535 | 6/1989 | Yokoi et al. | 271/22 |
| 5,085,419 | 2/1992 | Bell | 271/9 |
| 5,114,133 | 5/1992 | Osada et al. | 271/22 |
| 5,120,040 | 6/1992 | Worley | 271/9 |
| 5,190,278 | 3/1993 | Wallin et al. | 271/147 |
| 5,222,722 | 6/1993 | Kamano | 271/9 |
| 5,261,651 | 11/1993 | Ishida | 271/3 |
| 5,263,702 | 11/1993 | Labua | 271/171 |
| 5,348,283 | 9/1994 | Yanagi et al. | 271/127 |

FOREIGN PATENT DOCUMENTS

| | | | |
|---|---|---|---|
| 6234437 | 8/1994 | Japan | 271/171 |

*Primary Examiner*—David H. Bollinger
*Attorney, Agent, or Firm*—Ronald K. Aust; John J. McArdle, Jr.

[57] ABSTRACT

Disclosed is a replaceable media guide for use with a sheet feeding mechanism. The media guide includes a support plate, an edge guide projecting substantially at right angles from the support plate, and a first sheet engaging friction pad engaged with the support plate. The guide is designed so that the first friction pad faces a friction roller of a sheet feeding mechanism when the guide is mounted on the sheet feeding mechanism. A sheet feeding apparatus is also provided in which the media guide is inserted into the sheet feeding mechanism.

31 Claims, 2 Drawing Sheets

SPECIALTY MEDIA FEED GUIDE AND SHEET FEEDING APPARATUS USING SAME

FIELD OF THE INVENTION

The present invention relates generally to a sheet feeding apparatus and, more particularly, to a customer installable media guide for use with a sheet feeding mechanism for allowing customers to customize the sheet feeding mechanism for different types of media such as transparencies, postcards, greeting cards and paper having a high coefficient of friction.

DESCRIPTION OF THE PRIOR ART

Sheet feeding mechanisms employed in printers, copiers and the like must be able to feed a wide variety of media having different characteristics such as stiffness, thickness and coefficient of friction. Because of the wide variety of physical characteristics most sheet feeding mechanisms cannot successfully feed all the different types of media.

A typical sheet feeding mechanism is disclosed in U.S. Pat. No. 5,348,283. This sheet feeding mechanism includes rollers 1, 1' rotatably mounted to a roller shaft 2, a spring-loaded pressure plate 4, a separating claw 5 and friction pads 23. Separating claw 5 is usually constructed to separate media within a narrow range of thickness and stiffness. Friction pads 23 are made of material having a relatively high coefficient of friction, such as artificial leather and are arranged in confronting relation to the sheet supply rollers 1, 1' to reduce the double-feed of sheets. Typically, pads 23 are made of a material having a coefficient of friction against the media that is just slightly higher than the coefficient of friction between sheets of the media. Thus, this friction material is selected to have a coefficient of friction just higher than that of standard paper stock. While friction material having a suitable coefficient of friction can be selected for a wide range of media, in order to compensate for media having different coefficients of friction outside the range, the device must be internally reconfigured with different springs, spring placements, and the like. Furthermore, no provision is made to handle media having different stiffness and thickness.

Accordingly, there is a need for a customer installable device which can adapt a sheet feeder mechanism to be able to handle a wide variety of different media having varying thickness, texture, and coefficients of friction.

OBJECTS AND SUMMARY OF THE INVENTION

It is, therefore, an object of the present invention to provide a sheet feeding apparatus which solves the above-mentioned problems.

It is another object of the present invention to provide a sheet feeding apparatus having a replaceable friction pad which is simple in construction, effective in use and economical to manufacture.

It is another object of the present invention to provide a replaceable friction pad which can be used with a sheet feeding mechanism which is also simple in construction, effective in use and economical to manufacture.

These and other objects are achieved by providing a replaceable media guide for use with the sheet feeding mechanism. The media guide includes a support plate, an edge guide projecting substantially at right angles from the support plate, and a first sheet engaging friction pad engaged with the support plate. The guide is designed so that the first friction pad faces a friction roller of a sheet feeding mechanism when the guide is mounted on the sheet feeding mechanism. A sheet feeding apparatus is also provided in which the media guide is inserted into the sheet feeding mechanism.

These and other objects, advantages and features of the present invention will become more apparent from the following detailed description. Exemplary embodiments of the invention are provided in connection with the accompanying drawings.

DETAILED DESCRIPTION OF THE INVENTION

Figure 1:
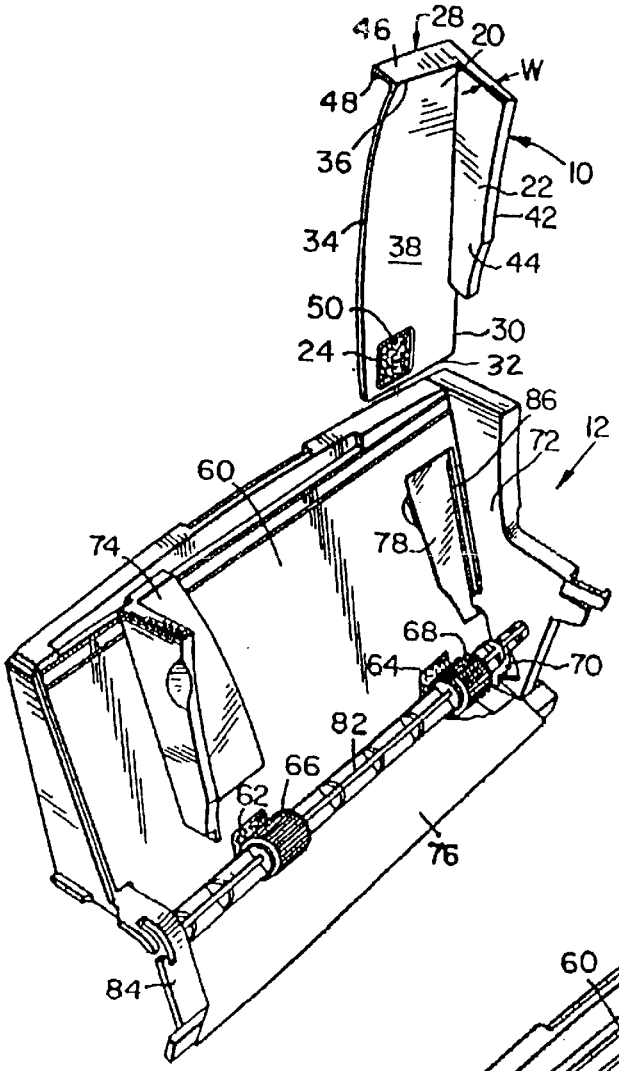
FIG. 1 is an exploded view according to a first embodiment of the present invention depicting a first media guide and an associated sheet feeding mechanism.
Figure 2:
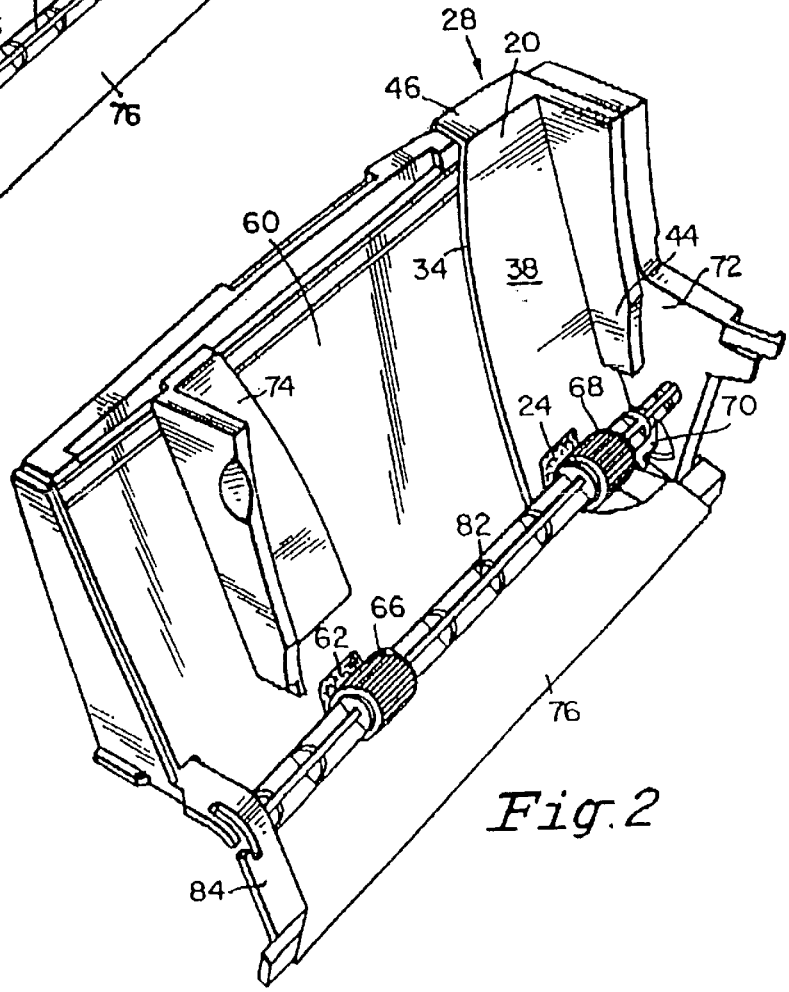
FIG. 2 is a view similar to FIG. 1 showing the media guide inserted into the sheet feeding mechanism.
Figure 3:
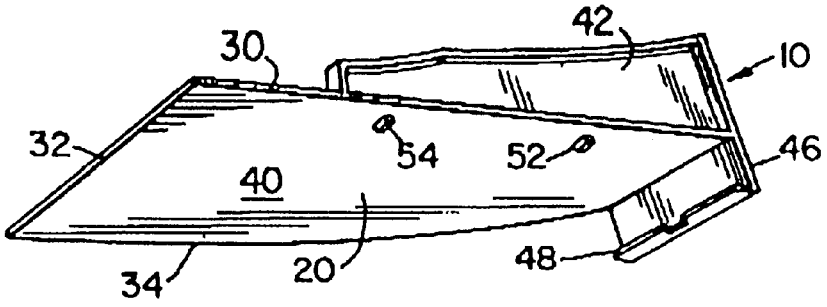
FIG. 3 is a bottom view of the media guide shown in FIGS. 1 and 2.

Referring first to FIGS. 1, 2 and 3, there is shown a media guide 10 which is constructed in accordance with the principles of the present invention. A conventional sheet feeding mechanism is generally indicated at 12. For convenience, media guide 10 and sheet feeding mechanism 12 will be described in relation to the orientation shown in FIGS. 1 and 2, and consequently terms such as "above," "left," and "bottom,", etc., as used herein are to be construed in the relative sense.

While the particular sheet feeder apparatus and/or media guide disclosed herein may be applicable to a wide variety of paper feeding situations, the exemplary embodiments disclose the use of a media guide as part of a sheet feeding mechanism for a printer such as an ink jet printer or a laser printer.

As shown in FIGS. 1–3, media guide 10 includes a support plate 20, an edge guide 22, a changeable friction pad 24, and an integral rearwardly projecting member 28 for engagement with sheet feeding mechanism 12. The support plate 20, edge guide 22, and projecting member 28 may be integrally formed from a thermoplastic material.

Support plate 20 has a straight right edge 30, a straight front edge 32, an arcuately shaped left edge 34 and a straight rear edge 36. Support plate 20 has a top surface 38 and a back surface 40. Edge guide 22 extends upwardly from top surface 38 and has a right side 42 coextensive with a portion of right edge 30 and a left side 44 which is parallel to right edge 30. Edge guide 22 also has a width W. Extending rearwardly from rear edge 36 and forming a portion of rearwardly projecting member 28 is a rearwardly projecting portion 46 and integral therewith and extending downwardly therefrom is a downwardly projecting portion 48. As shown in FIG. 3, extending rearwardly from back surface 40 are rearwardly projecting tabs 52, 54.

Changeable friction pad 24 is approximately square and is mounted to support plate 20 proximate to front edge 32 and close to left edge 34 as shown in FIG. 1 within a recess 50. Friction pad 24 is mounted to support plate 20 by any suitable means such as an adhesive, an interlocking tab or the like. It should be understood that any suitable means that allows friction pad 24 to be securely mounted to support plate 20 during use but permits pad 24 to be easily changed or replaced would be useable in this invention. This permits the user, with a single media guide and a variety of friction pads 24, to cover a wide range of media. The coefficient of friction of pad 24 may be equal to, or different from, the coefficient of friction of surface 38 of support plate 20. Preferably, the coefficient of friction of pad 24 is in a range of about 0.2 to about 1.6, and more preferably, greater than about 0.8.

As shown in FIGS. 1 and 2, the sheet feeding mechanism 12 includes a thermoplastic pressure plate 60, friction pads 62, 64 mounted to pressure plate 60, rollers 66, 68 mounted in opposed relation to friction pads 62, 64 respectively, a sheet separation device 70 such as a corner buckler, friction separator or the like, a fixed side guide member 72, a movable side guide member 74, heavy media supports 76, and a heavy media guide 78.

Pressure plate 60 is biased upwardly by springs (not shown) to keep friction pads 62, 64 in biased relation with rollers 66, 68, respectively. Fixed side guide member 72, heavy media supports 76, and movable side guide member 74 are arranged on the sheet feeder mechanism 12 to accommodate paper sheets of various widths. Movable side guide member 74 is adjustable relative to fixed side guide member 72 by shifting the movable side guide member 74. Pressure plate 60, adjacent to heavy media supports 76, is downwardly pivotable such that sheets of paper can be fed between pressure plate 60 and rollers 66, 68.

As shown in FIG. 1, a sheet supply roller shaft 82 extends between fixed side guide member 72 and a left fixed drive member 84. Roller shaft 82 is connected to a drive mechanism (not shown) so that the driving force from feed rollers 66, 68 is transmitted to the upper-most sheet directly in contact therewith and mounted between rollers 66, 68 and pressure plate 60. When the roller shaft 82 and rollers 66, 68 are rotated by one or more revolutions, only the upper-most sheet is separated from the other sheets by means of sheet separation device 70, such as a corner buckler, friction separator or the like and fed towards heavy media support 76. Separation device 70 is arranged only at one corner of the device between right fixed side guide member 72 and heavy media support 76.

Heavy media guide 78 is pivotably mounted to support plate 60 and is movable from a generally horizontal inoperative position (shown in FIG. 1) to a vertical operative position (not shown). Guide 78, in the vertical operative position, extends parallel to right fixed guide member 72. Guide 78 is located a fixed distance from right fixed side guide member 72 so that separation device 70 will not be engaged when paper is fed by rollers 66, 68. Guide 78 is used when thick or stiff media is fed which would not be effectively separated by separation device 70, and such thick or stiff media is effectively separated by heavy media support 76.

Friction pads 62, 64 are typically made of a material such as cork having a relatively great coefficient of friction, such as about 0.8, and are arranged on pressure plate 60 in opposed relation to rollers 66, 68 to reduce the double-feed of sheets.

As shown in FIG. 2, media guide 10 is inserted in between roller 68 and pressure plate 60 such that changeable friction pad 24 is directly above friction pad 64. Preferably, friction pad 24 has a coefficient of friction different from the coefficient of friction of friction pad 64. Heavy media guide 78 is placed in the horizontal inoperative position before media guide 10 is inserted. Media guide 10 engages a rear portion of sheet feeding mechanism 12 by means of rearwardly projecting member 28. Rearwardly projecting tabs 52, 54 engage a slot 86 which is formed in heavy media guide 78. The type of friction pad 24 mounted to media guide 10 is dependent on the type of media to be fed. Different materials which may be used for friction pad 24 include thermoplastic elastomers, corks, plastics, sponge materials, and cottons, among others. In this manner, the sheet feeding mechanism 12 can be customized to feed many types of media such as greeting cards which are frequently textured and therefore have a relatively high coefficient of friction compared to standard paper stock.

This first embodiment of the sheet feeding apparatus including the media guide is particularly useful with relatively narrow media which only extend across one friction pad 64 when one side of the media is placed against fixed side guide member 72. This is because roller 66 will not engage friction pad 62 when media guide 10 is inserted between roller 68 and pressure plate 60 due to roller 66 being spaced from friction pad 62.

Figure 4:
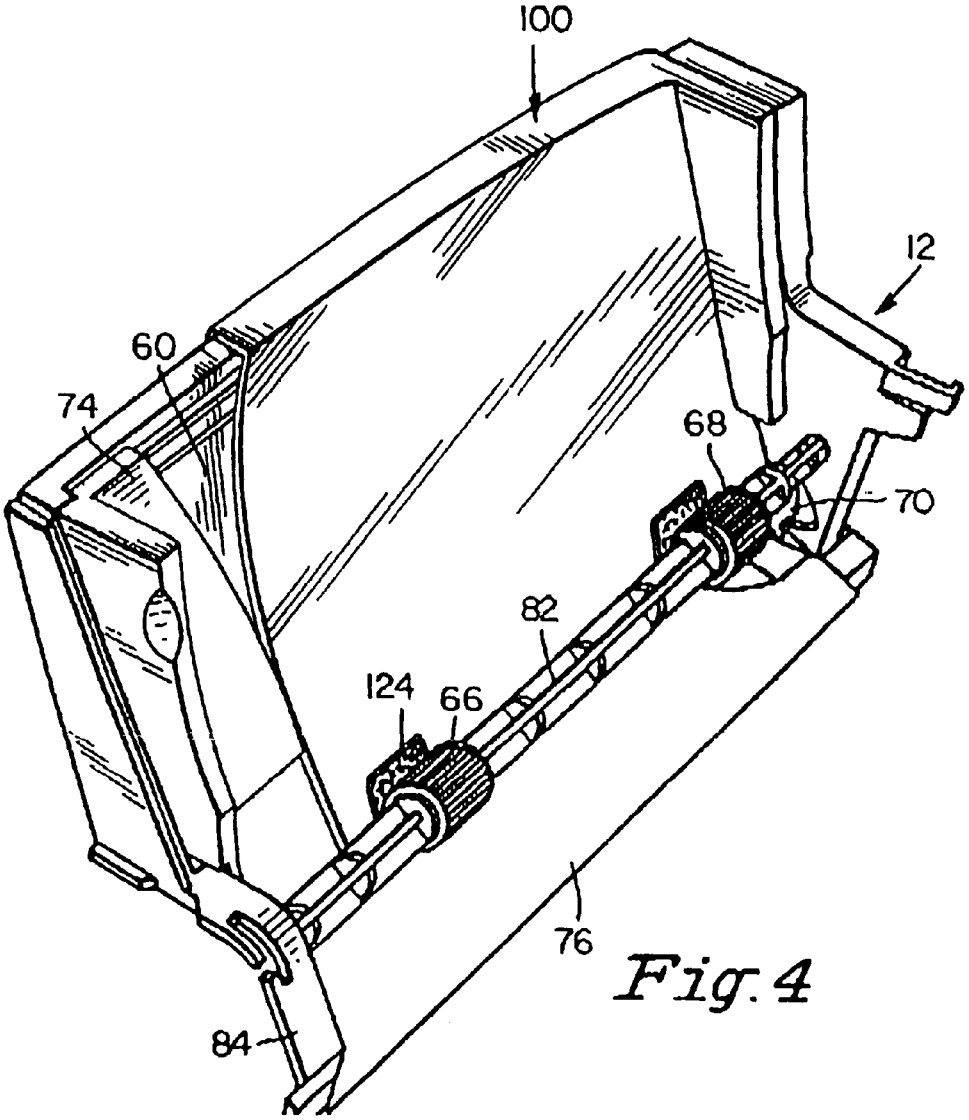
FIG. 4 is a persective view of a second embodiment of the present invention depicting a second media guide.

Referring now to FIG. 4, a second embodiment of a media guide 100 is shown. This embodiment is particularly useful for media having a width which would extend across both friction pads 62, 64 shown in FIG. 1. Having two friction pads 124 in engagement with media being fed prevents skewing. If only one friction pad 24 is engaged with a relatively wide sheet, the sheet might become skewed while being fed. This embodiment differs from the first embodiment in that a second changeable friction pad 124 is mounted to media guide 100.

It should be apparent from the foregoing detailed description that a replaceable media guide has been described which can allow sheet feeding mechanisms to handle many different types of media without requiring any alteration to the sheet feeding mechanism. Furthermore, it is contemplated that the friction pads associated with media guides 10 and 100 may be formed integral with the respective guide, such as for example, by selecting a material for the media guide having the desired frictional characteristics, or by machining a surface of the media guide.

While this invention has been described using exemplary presently preferred embodiments, it is understood that many modifications can be made to the invention without departing from its spirit or scope. Accordingly, the invention is not limited by the foregoing description and drawings, but is only limited by the scope of the appended claims.

What is claimed is:

1. A media guide for use with a sheet feeding mechanism, comprising:

a support plate;

an edge guide projecting substantially at right angles from said support plate;

a first sheet engaging friction pad engaged with said support plate; and an engagement mechanism for removably mounting said media guide to the sheet feeding mechanism.

2. The media guide of claim 1, further comprising engagement means for releasably mounting said first pad to said support plate.

3. The media guide of claim 1, further comprising a second sheet engaging friction pad engaged with said support plate.

4. The media guide of claim 3, further comprising engagement means for releasably mounting said second sheet engaging friction pad to said support plate.

5. The media guide of claim 1, wherein said support plate has a side edge, said edge guide extending inwardly therefrom.

6. The media guide of claim 1, wherein said engagement mechanism comprises a member extending outwardly from a rear edge of said support plate for engagement with the sheet feeding mechanism and a back surface on said support plate which has at least one projecting portion extending therefrom for engagement with the sheet feeding mechanism.

7. The media guide of claim 1, wherein said engagement mechanism comprises a member extending outwardly from a rear edge of said support plate for engagement with the sheet feeding mechanism.

8. The media guide of claim 1, wherein said engagement mechanism comprises a back surface on said support plate which has at least one projecting portion extending therefrom for engagement with the sheet feeding mechanism.

9. The media guide of claim 1, wherein said support plate has a front edge, said pad being mounted proximate thereto.

10. The media guide of claim 1, wherein said first sheet engaging friction pad and said support plate have different coefficients of friction.

11. The media guide of claim 1, wherein said first sheet engaging friction pad has a higher coefficient of friction than said support plate.

12. A sheet feeding apparatus, comprising:

a sheet feeding mechanism; and a media guide engaged with said sheet feeding mechanism, said media guide including;

a support plate;

an edge guide projecting substantially at right angles from said support plate;

a first sheet engaging friction pad engaged with said support plate; and an engagement mechanism for removably mounting said media guide to said sheet feeding mechanism.

13. The sheet feeding apparatus of claim 12, wherein said sheet feeding mechanism includes a first friction sheet engaging friction pad and a first corresponding sheet roller mounted in opposed relation thereto, said first sheet engaging friction pad of said media guide being mounted between said first friction pad and said first corresponding roller.

14. The sheet feeding apparatus of claim 13, wherein said first sheet engaging friction pad of said media guide has a different coefficient of friction than said first sheet engaging friction pad.

15. The sheet feeding apparatus of claim 13, wherein said sheet feeding mechanism includes a second sheet engaging friction pad and a second corresponding sheet roller mounted in opposed relation thereto, and wherein said media guide includes a second sheet engaging friction pad engaged with said support plate, said second sheet engaging friction pad of said media guide being mounted between said second sheet engaging friction pad and said second corresponding roller.

16. The sheet feeding apparatus of claim 12, wherein said sheet feeding mechanism includes:

a pressure plate for supporting sheets thereon and biased in one direction;

a first sheet engaging friction pad attached to said pressure plate and disposed beneath said first sheet engaging friction pad of said media guide;

a first roller rotatably mounted above said sheet engaging friction pad for feeding the sheets;

separating means for separating the sheets one by one to be fed out by said first roller;

a first guide member for guiding one of a pair of lateral edges of the sheets supported on said pressure plate, said first guide member being fixed and located near said separating means; and a second guide member for guiding the other of said pair of said lateral edges of the sheets supported on said pressure plate, said second guide member being movable in accordance with the sizes of the sheets;

wherein said edge guide of said media guide is mounted adjacent to said first guide member.

17. The sheet feeding apparatus of claim 16, wherein said separating means extends a distance outwardly from said first guide member in a direction towards said pressure plate, wherein said edge guide of said media guide has a width greater than the distance that said separating means extends.

18. The sheet feeding apparatus of claim 12, further comprising engagement means for releasably mounting said first sheet engaging friction pad to said support plate.

19. The sheet feeding apparatus of claim 12, further comprising a second sheet engaging friction pad engaged with said support plate.

20. The sheet feeding apparatus of claim 19, further comprising engagement means for releasably mounting said second sheet engaging friction pad to said support plate which permits said second pad to be replaced.

21. The sheet feeding apparatus of claim 12, wherein said engagement mechanism comprises a member extending outwardly from a rear edge of said support plate for engagement with the sheet feeding mechanism and a member extending outwardly from a rear edge of said support plate for engagement with said sheet feeding mechanism.

22. The sheet feeding apparatus of claim 12, wherein said engagement mechanism comprises a member extending outwardly from a rear edge of said support plate for engagement with said sheet feeding mechanism.

23. The sheet feeding apparatus of claim 12, wherein said engagement mechanism comprises a back surface on said support plate which has at least one projecting portion extending therefrom for engagement with said sheet feeding apparatus.

24. The sheet feeding apparatus of claim 12, wherein said support plate has a front edge, said sheet engaging friction pad being mounted proximate thereto.

25. The sheet feeding apparatus of claim 12, wherein said first sheet engaging friction pad and said support plate have different coefficients of friction.

26. The sheet feeding apparatus of claim 12, wherein said first sheet engaging friction pad has a higher coefficient of friction than said support plate.

27. A media guide for use with a sheet feeding mechanism, comprising:

a support plate including a first region having a coefficient of friction different from a second region of said support plate;

an edge guide projecting substantially at right angles from said support plate; and, an engagement mechanism for removably mounting said media guide to the sheet feeding mechanism.

28. A media guide for use with a sheet feeding mechanism, comprising:

a support plate having a predetermined coefficient of friction;

an edge guide projecting substantially at right angles from said support plate; and, an engagement mechanism for removably mounting said media guide to the sheet feeding mechanism.

29. The media guide of claim 28, wherein said predetermined coefficient of friction is greater than about 0.8.

30. The media guide of claim 28, wherein said predetermined coefficient of friction is in a range of about 0.2 to about 1.6.

31. A sheet feeding apparatus comprising:

a sheet feeding mechanism; and a media guide engaged with said sheet feeding mechanism including a region with a first coefficient of friction, said media guide including:

a support plate having a region with a second coefficient of friction different from said first coefficient of friction;

an edge guide projecting substantially at right angles from said support plate; and an engagement mechanism for removably mounting said media guide to said sheet feeding mechanism.

* * * * *